US006164418A

United States Patent [19]

Chen et al.

[11] Patent Number: 6,164,418

[45] Date of Patent: Dec. 26, 2000

[54] ELEVATING WORK PLATFORM STRUCTURE

[76] Inventors: Ching Hung Chen, 401. Jong Jou. Shyue Jea Town, Tainan Shyuan; Pei Ping Huang; Pei Kai Huang, both of 68-17 Shin Lian. Poh Tzyy City, Jia Yih Shyuan, all of Taiwan

[21] Appl. No.: 09/263,657

[22] Filed: Mar. 5, 1999

Related U.S. Application Data

[60] Provisional application No. 60/080,140, Mar. 31, 1998.

[51] Int. Cl.[7] ..... B66B 11/02

[52] U.S. Cl. ..... 187/401; 187/361; 187/365; 187/366

[58] Field of Search ..... 187/351, 361, 187/363, 364, 365, 366, 369, 401

[56] References Cited

U.S. PATENT DOCUMENTS

| | | | |
|---|---|---|---|
| 401,106 | 4/1889 | Backman | 187/361 |
| 595,943 | 12/1897 | Dorn | 187/366 |
| 972,252 | 10/1910 | Rogers | 187/369 |
| 5,353,895 | 10/1994 | Cammack et al. | 187/369 |
| 5,816,369 | 10/1998 | Skalski | 187/410 |
| 5,957,243 | 9/1999 | Root et al. | 187/266 |
| 6,047,792 | 4/2000 | Jin et al. | 187/401 |

FOREIGN PATENT DOCUMENTS

| | | | |
|---|---|---|---|
| 003739654 | 6/1989 | Germany | 187/361 |
| 403120183 | 5/1991 | Japan | 187/401 |
| 403259890 | 11/1991 | Japan | 187/401 |
| 404153179 | 5/1992 | Japan | 187/343 |
| 406100266 | 4/1994 | Japan | 187/401 |

*Primary Examiner*—Robert P. Olszewski
*Assistant Examiner*—Paul T. Chin
*Attorney, Agent, or Firm*—Raymond Y. Chan; David and Raymond

[57] ABSTRACT

An elevating work platform structure for use in constructing an elevator channel before and after the elevator car has been placed into the elevator channel includes a horizontal beam, two side posts connected to two ends of the horizontal beam, two upper platforms integrally connected to two upper side ends of the two side posts respectively, two lower platforms integrally connected to two lower side ends of the two side posts respectively, and two safety brake arrangements provided at a lower front portion of each of the side posts for providing an instant emergency brake if the suspension cable holding up said elevating work platform structure breaks.

20 Claims, 5 Drawing Sheets

ELEVATING WORK PLATFORM STRUCTURE

CROSS-REFERENCE OF RELATED APPLICATION

This is a regular utility patent application of a provisional application, application Ser. No. 60/080,140, filed Mar. 31, 1998.

BACKGROUND OF THE PRESENT INVENTION

The present invention relates to a piece of elevator equipment, and more particularly to an elevating work platform structure for aiding the construction within an elevator room ("an elevator channel"), replacing the function provided by the conventional scaffold, in which the elevating platform structure can still be used within the elevator channel after an elevator is fully installed within the elevator channel.

The conventional method for elevator construction inside a building (such as an elevator using guide rails or guide wires) is to first construct a scaffold, or an elevating work platform, within the elevator channel that allows an construction worker to maneuver and transport equipment from floor to floor. However, the conventional scaffold not only takes a long time to build and take down after the elevator and elevator channel have finished construction, but also is relatively expensive to construct, thereby making the conventional scaffold economically inefficient.

Regardless of the construction method, the main machinery used for holding a conventional scaffold for conventional construction of an elevator is a winding machine. The winding machine guides an main suspension cable of the elevating work platform 20, as shown in FIG. 1 of the drawings. In order to maintain the balance of the elevating work platform, there are usually additional supporting suspension cables connected to the elevating work platform to guide and prevent the elevating work platform from spinning. Based on different construction conditions, the elevator guide rails that are already installed may also be used to replace the additional supporting suspension cable. Under such conditions, the elevating work platform can still be used to perform different tasks, even when the building does not yet have electrical power. A worker uses the elevating work platform to install elevator inner doors on each floor, to wire the elevator and the elevator channel, to continually remove rust from the elevator guide rails, and to install the elevator car cable and counterweight, among other tasks.

One problem with the conventional elevating work platform, especially the type that is guided by a suspension cable, is that when the worker is performing tasks while on the elevating work platform, the worker's movements may cause the elevating work platform to have a pendulum motion. The pendulum motion in turn not only affects the worker's ability to do his job, but also poses a risk to the worker of falling off the platform. Alternatively, a conventional elevating work platform that uses the elevator guide rails may not be used until the elevator guide rails have passed inspection.

SUMMARY OF THE PRESENT INVENTION

The main object of the present invention is to provide a an elevating work platform structure, which can be easily assembled and disassembled for use in the elevator channel before and after the completion of the elevator to save time and money in constructing the elevator and the elevator channel.

Another objective of the present invention is to provide an elevating work platform structure, with a locking device that affixes the elevating work platform inside the elevator channel when a worker is on the elevating work platform and performing a job task.

Accordingly, an elevating work platform structure comprises a horizontal beam, two vertical side posts connected to two ends of the horizontal beam, two upper platforms integrally connected to opposing sides of two upper side ends of the two side posts respectively, such that the horizontal beam sits in the play dividing the two platforms, two lower platforms integrally connected to two lower sides of the two sides posts respectively, such that they are directly below the respective two upper platforms, and two safety brake arrangements provided at a lower front portion of each of the side posts for providing an instant emergency brake during an emergency situation.

The elevator work platform may further comprise a press lock bar integrally connecting underneath and across the two lower platforms, such that one end of the press lock bar presses against one wall of the elevator channel and the other end of the press lock bar presses against the opposing wall of the elevator channel providing greater stability in the elevator channel as a worker works on the platform.

DETAILED DESCRIPTION OF THE PREFERRED EMBODIMENT

Figure 1:
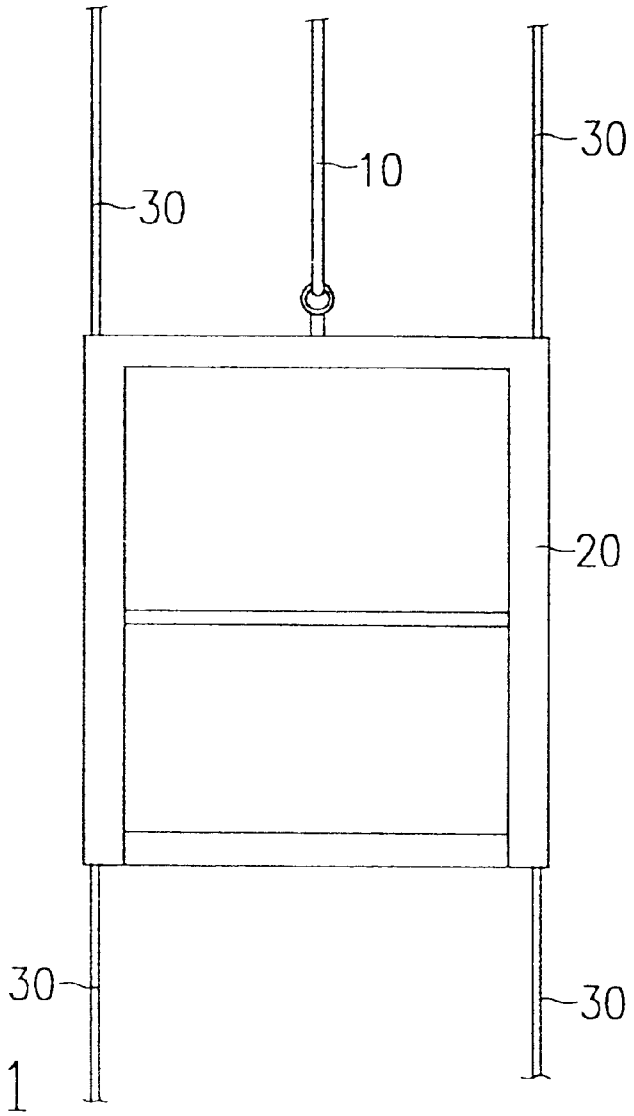
FIG. 1 is a front view of a traditional elevating work platform
Figure 4:
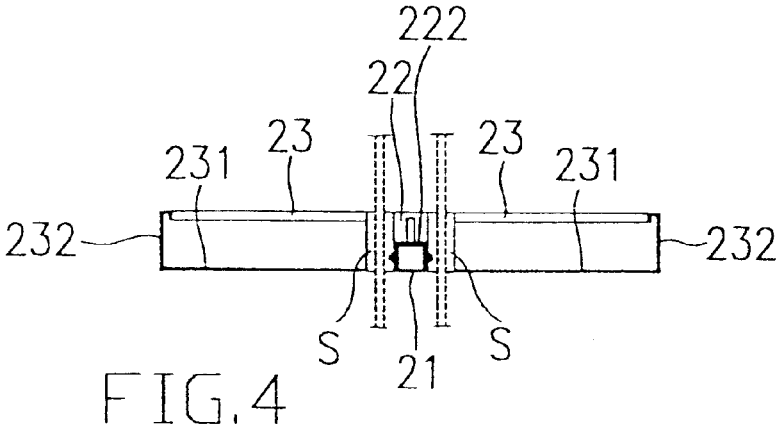
FIG. 4 is a sectional end view along sectional line A—A of FIG. 2 according to the above first preferred embodiment of the present invention.
Figure 2:
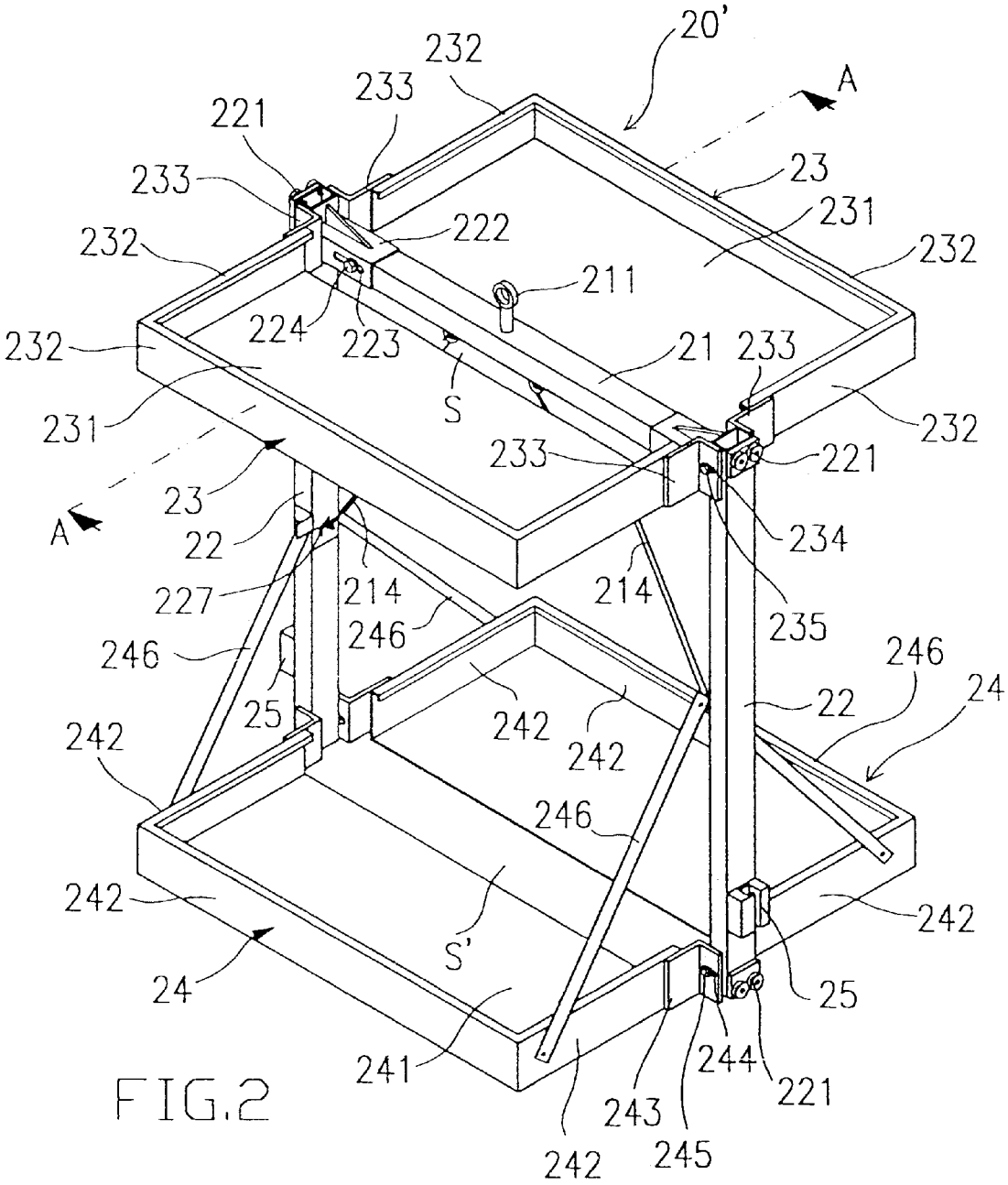
FIG. 2 is a perspective view of an elevating work platform structure according to a first preferred embodiment of the present invention.
Figure 3:
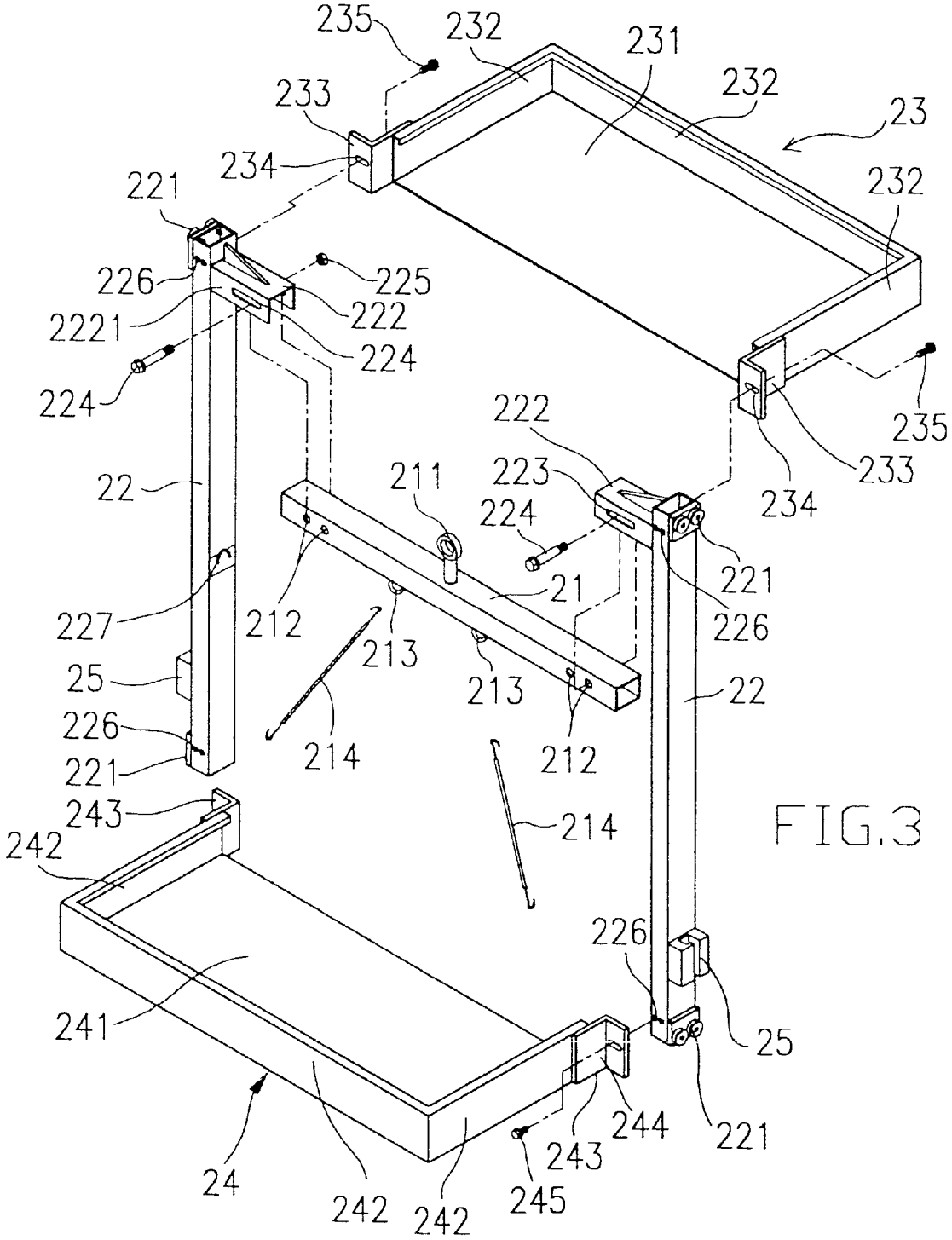
FIG. 3 is an exploded view of the elevating work platform structure according to the above first preferred embodiment of the present invention.

Referring to FIGS. 2 to 4 of the drawings, an elevating work platform structure of according to a first preferred embodiment of the present invention is illustrated. The elevating work platform structure comprises a horizontal beam 21, two side posts 22 vertically connected to two ends of the horizontal beam 21, two upper platforms 23 integrally connected to opposing sides of two upper side ends of the two sides posts 22 respectively, two lower platforms 24 integrally connected to opposing sides of two lower side ends of the two side posts 22 respectively, and two safety break arrangements 25 provided at a lower front portion of each side post 22, such that if the main suspension cable 10 breaks, the safety brake arrangement can immediately stop the elevating work platform structure from falling.

Referring to FIGS. 2 and 3 of the drawings, the horizontal beam 21 having a cable ring 211 at its center position thereof for a main suspension cable 10 guided by a winding machine to insert therethrough. Two end portions of the horizontal beam 21 have a plurality of through holes 212. A top outer end and a bottom outer end of each side post 22 further comprises a pair of guiding rollers 221. Each "n" shaped connector 222 is opposed integrally and attached to each of a top rear end of each side post 22, which enables each end of the horizontal beam 21 to engage therein, respectively. The two vertical pieces 2221 of each "n" shaped connector 222 provide an elongated through hole 223 for allowing the horizontal beam 21 to engage each n-shaped connector 222 on either side by fittingly sitting within each connector 222, by a screw bolt 224 penetrated through the elongated through hole 223 and the through hole 212 on the end portion of the horizontal beam 21 to be engaged with a nut 225 so as to affix the horizontal beam 21 to the side posts 22. A top side end and a bottom side end of each side post 22 provide a plurality of screw holes 226.

The upper platform 23 comprises a "n" shaped frame 232 and an upper platform portion 231 bounded by the "n" shaped frame 232, wherein each of two symmetrical ends of the "n" shaped frame 232 is integrally connected to a "L" shaped connecting piece 233, said "L" shaped connecting piece 233 having a through hole 234 provided thereon through which a screw 235 inserts through the screw hole 225 of the top side end of the side post 22 thereby connecting said "L" shaped connecting piece 233 to a side post 22 for allowing the upper platform 23 to connect with the side posts 22. When the upper platform 23 is connected to the side posts 22, a space S exists between the edge of the upper platform portion 231 of the upper platform 23 and the horizontal beam 21.

The bottom platform 24 has an identical structure to the upper platform 23 which comprises a "n" shaped frame 242 and a lower platform portion 241 bounded by the "n" shaped frame 242, wherein each of two symmetrical ends of the "n" shaped frame 242 is integrally connected to a "L" shaped connecting piece 243, said "L" shaped connecting piece 243 having a through hole 244 provided thereon through which a screw for allowing the lower platform 24 to connect with the sides posts 22 by a screw 245 screwed through the through hole 244 and into the screw hole 226 of the bottom side end of the side post 22. When the lower platform 24 is connected to the side posts 22, a space S' exists between the edges of the lower platform portions 241 of the lower platform 24.

Referring to FIG. 4 of the drawing, after the complete installation of the elevator car in the elevator channel, the elements of the elevating work platform structure of the present invention are placed within the elevator channel through an elevator door for construction work within the elevator channel. The elevating work platform is constructed within the elevator channel such that the main suspension cable 10 and the additional supporting suspension cables 30 are designed to connect with the elevator car through the space S and S'. Consequently, during the installation process of the present invention, the main suspension cable 10 and the additional supporting suspension cables 30 are confined by the upper platform portion 231 and lower platform portion 241 within the upper space S and the lower space S' allowing the elevating work platform structure to function without entangling or otherwise hindering the elevator cables 10, 30.

Moreover, the elongated through hole 223 of the "n" shaped connector 222 and the through holes 234, 244 of the "L" shaped connecting pieces 233,243 of the present invention may be adjusted making the distance between the two sides posts 22 closer or farther, so that the elevating work platform structure can be flexibly installed within elevator channels of various sizes.

Referring to FIGS. 2 and 3 of the drawings, the horizontal beam 21 of the elevating work platform 20' further comprises a plurality of tension rings 213 disposed on the lower surface of the horizontal beam 21. Each of the side posts 22 comprises a hook ring 227 disposed at a center inner surface of the side posts 22. Two tension adjusting cables 214 each with one end hook on the tension ring 213 of the horizontal beam 21 and the other end hook on the hook ring 227 of each side post 22, respectively, for adjusting the tension on the elevating work platform. Moreover, referring to FIG. 2, a reinforced bar 246 is provided to connect the lower platform 24 with the side posts 22 so as to enhance the load ability of the lower platform 24.

Figure 5:
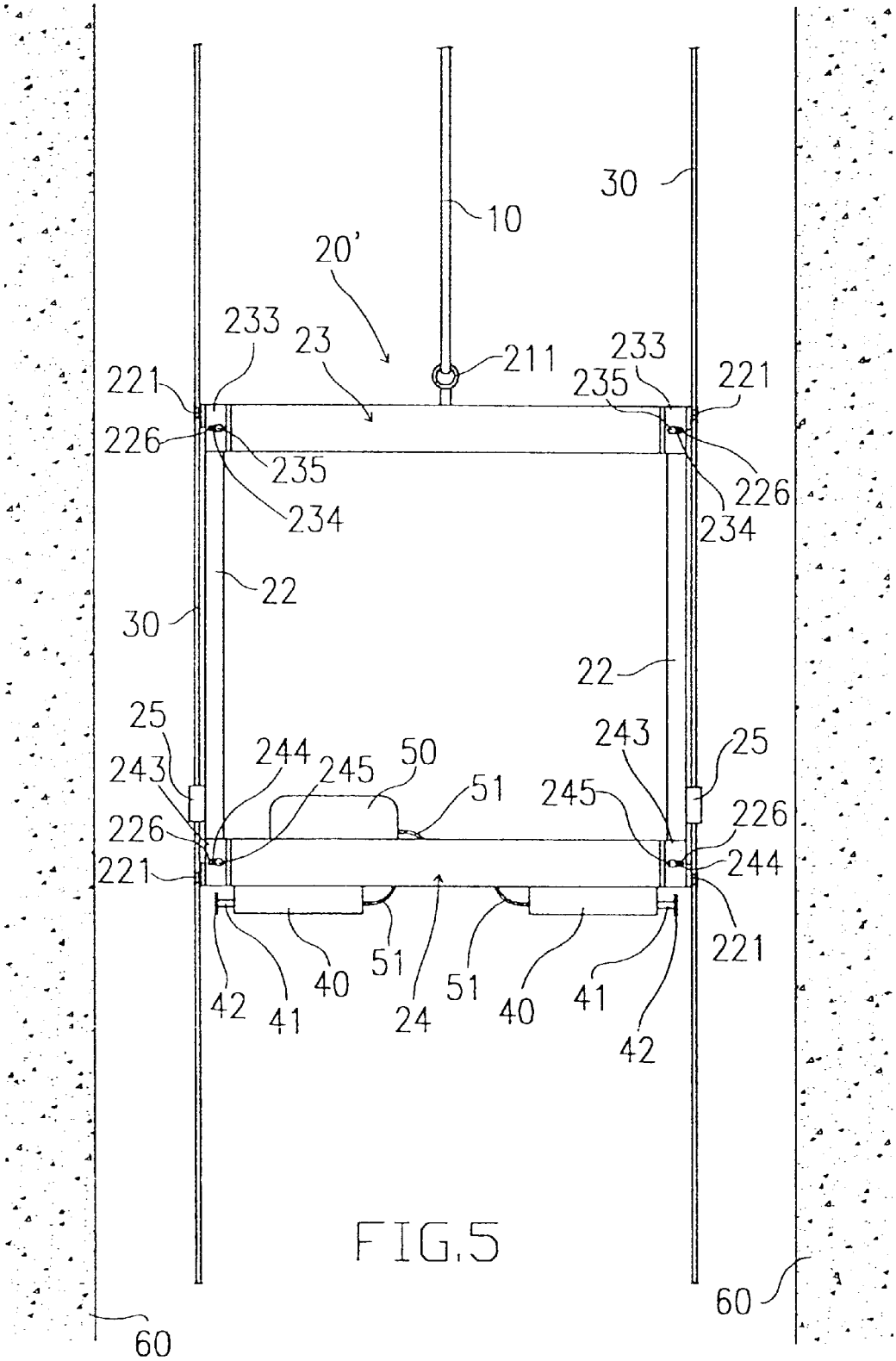
FIG. 5 is a front view of the elevating work platform structure according to a second preferred embodiment of the present invention.
Figure 6:
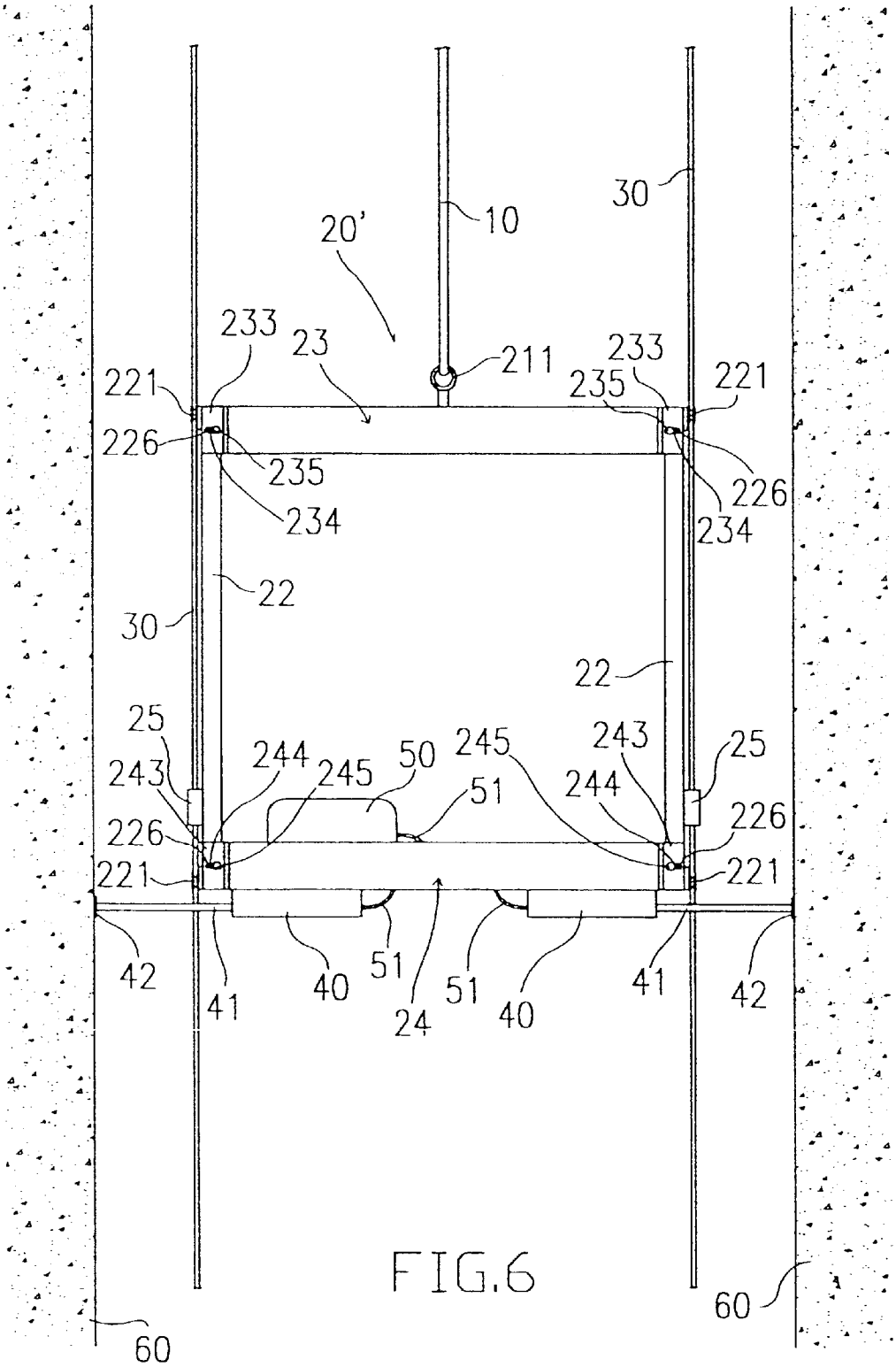
FIG. 6 is a front view of the elevating work platform structure according to the above second preferred embodiment of the present invention, wherein a press lock bar is extended toward two opposing inner walls of an elevator channel and a supporter is pressed against the two inner walls.

Referring to FIGS. 5 and 6 of the drawings, an elevating work platform structure according to a second preferred embodiment of the present invention is illustrated. The elevating work platform structure of the present invention further comprises a locking device for affixing the elevating work platform 20' for providing a volume of highly compressed air, a plurality of air tubes 51 for connecting between the air compressor 50 and each air compressing cylinders 40, a press lock bar 41 received within each of the air compressing cylinders 40, and a supporter 42 provided at the end of a press lock bar.

As shown in FIG. 6, when the construction workers want to lock the elevating work platform 20' at a certain desired height, the highly compressed air generated from the air compressor 50 would be forced through the air tubes 51 to each air compressing cylinders 40 which would push out the press lock bar 41 until the supporter 42 is pressed against an inner wall 60 of the elevator channel, so as to rigidly secure the elevating work platform 20' within the elevator channel. Therefore, when the construction workers are performing tasks while on the elevating work platform 20', the pendulum movement of the elevating work platform 20' can be eliminated, allowing the workers to perform their tasks, while safeguarding them from falling off the elevating work platform.

In accordance with the preferred embodiments described above, the preferred embodiments are just examples of what the present invention can accomplish, and should not be considered a limitation of what the present invention can achieve. Any limitations for determining issues of equivalent infringement are therefore reflected in the claims section.

We claim:

1. An elevating work platform structure for constructing an elevator channels, comprising:

a horizontal beam structure, further comprising a beam and a ring extending up from the middle of an upper surface of said beam for attaching a suspension cable to lower and raise said elevating work platform structure within said elevator;

two vertical posts structures, further comprising two vertical posts, and a guiding means on the outside of each of said vertical posts for guiding said elevating work platform structure within said elevator channel by a set of guiding cables;

said beam located between said posts, and attaching at each of said beam's ends perpendicularly connecting to the upper end of said posts by a set of two beam attaching means;

two upper platforms;

each of said upper platforms integrally connecting to opposing sides of the upper end of said posts by a set of two platform attaching means such that an upper platform space is defined on either side of said beam between said beam and each of said upper platforms;

two lower platforms;

each of said lower platforms integrally connecting to opposing sides of the lower end of said posts by a set of two platform attaching means such that a lower platform space is defined between said lower platforms; and an emergency braking means integrally connecting to the front lower portion of said two sides posts, respectively, for providing an emergency brake immediately if said suspension cable breaks.

2. An elevating work platform structure as recited in claim 1, each of said upper platforms further comprising a rectangular base platform and an n-shaped frame integrally connected along the top of three edges of said platform base such that the edge not bounded by the frame faces inward to said beam, the opposing upper platform; and each of said lower platforms further comprising a base platform and an n-shaped frame integrally connected along the top of three edges of said platform base such that the edge not bounded by the frame faces inward to said beam, the opposing upper platform.

3. An elevating work platform structure as recited in claim 2, wherein said beam attaching means further comprises a pair of n-shaped connectors and a set of four screws;

said n-shaped connector further comprising a flat base piece integrally attached to two perpendicular side pieces on either side of said base thereby defining a beam space between said base and said sides, and a brace piece integrally attached perpendicularly to the outer face of said base piece for adding additional bracing strength when said n-shaped connector is attached to said vertical posts and holds said beam;

each of said n-shaped connector affixedly attaching at one end to the upper inside side of said vertical side post such that the other end of said n-shaped connector opposedly faces the unattached end of the other n-shaped connector and said beam space faces down;

said beam space having a width wider than said beam such that said beam is fittingly placed into said beam space when said elevating platform structure is being used; and said beam having a plurality of through screw holes, on each end of said beam where said beam connects to said side pieces via said n-shaped connector side pieces; said side pieces further defining an elongated oval hole such that said beam may be attached to said n-shaped connector by inserting a screw, one each through each of the elongated oval holes and one of said through holes, such that said distance between said vertical posts may be varied depending on where along said elongated oval hole, said screw is inserted through said through hole on said beam.

4. An elevating work platform structure as recited in claim 3, said platform attaching means further comprising a set of L-shaped connectors and a set of platform screws, one of said L-shaped connector and one of said platform screws per each of said upper and lower platforms;

said vertical posts having one screw hole on each side of said upper end facing in the same direction as said upper platform on the same place as said beam, and one screw hole on the lower end of said vertical posts, directly under each screw hole of said upper platform;

said upper and lower platforms each having on each side edge of said frame, receiving screw holes for attaching said L-shaped connectors to said platforms;

said L-shaped connector further comprising two flat pieces integrally and perpendicularly connecting along one edge at a 90 degree angle;

each set of two of said L-shaped connectors attaching to said upper and lower ends of each of said vertical side posts next to said frames of said upper and lower platforms, respectively, such that one side integrally attaches to the side of said vertical side post, and the edge of said other piece extends out perpendicularly along the edge of the side of said platform frame; and the face of said other piece fixedly attaching to the outside of said side panels of said platform such there is the L-connector attaches to said platform on either said of said frame of said platform.

5. An elevating work platform structure as recited in claim 4, said guiding means further comprising two sets of two guiding rollers integrally attached to the outside of each of said side posts at the upper and lower end for guiding said elevating work platform along elevator cables.

6. An elevating work platform structure as recited in claim 5, further comprising a locking mechanism for affixing the elevating work platform within the elevator channel, said locking mechanism further comprising an air compressor for providing a volume of highly compressed air, a plurality of air tubes for connecting between the air compressor and each air compressing cylinders, a press lock bar received within each of the air compressing cylinders, and a supporter provided at the end of a press lock bar, such that the highly compressed air generated from the air compressor would be forced through the air tubes to each air compressing cylinders which would push out the press lock bar until the supporter is pressed against an inner wall of the elevator channel, so as to rigidly secure the elevating work platform within.

7. An elevating work platform structure as recited in claim 6, said horizontal beam further comprising a plurality of tension rings disposed on the lower surface of said horizontal beam;

each of said side posts further comprises a hook ring disposed at a center of said inner surface of said side posts; and two tension adjusting cables, each with two hooking ends, one end of each of said tension cable hooking on one of said tension rings of the horizontal beam and the other end of each of said tension cable hooking on the hook ring of each side post, respectively, for adjusting the tension on the elevating work platform.

8. An elevating work platform structure as recited in claim 7, said side posts further comprising a set of reinforced bars for enhancing the load ability of the lower platform; and said reinforced bars attaching to the middle of one of the surfaces of said side posts and extending outward on either side of said side posts attaching to either side of said frame of said lower platforms.

9. An elevating work platform structure as recited in claim 1, wherein said beam attaching means further comprises a pair of n-shaped connectors;

said n-shaped connector further comprising a flat base piece integrally attached to two perpendicular side pieces on either side of said base thereby defining a beam space between said base and said sides, and a brace piece integrally attached perpendicularly to the outer face of said base piece for adding additional bracing strength when said n-shaped connector is attached to said vertical posts and holds said beam;

each of said n-shaped connector affixedly attaching at one end to the upper inside side of said vertical side post such that the other end of said n-shaped connector opposedly faces the unattached end of the other n-shaped connector and said beam space faces down;

said beam space having a width wider than said beam such that said beam is fittingly placed into said beam space when said elevating platform structure is being used; and said beam having a plurality of through screw holes on each end of said beam where said beam connects to said side pieces via said n-shaped connector side pieces; said side pieces further defining an elongated oval hole such that said beam may be attached to said n-shaped connector by inserting a screw, one each through each of the elongated oval holes and one of said through holes, such that said distance between said vertical posts may be varied depending on where along said elongated oval hole, said screw is inserted through said through hole on said beam.

10. An elevating work platform structure as recited in claim 9, said platform attaching means further comprising a set of L-shaped connectors and a set of platform screws, one of said L-shaped connector and one of said platform screws per each of said upper and lower platforms;

said vertical posts having one screw hole on each side of said upper end facing in the same direction as said upper platform on the same place as said beam, and one screw hole on the lower end of said vertical posts, directly under each screw hole of said upper platform;

said upper and lower platforms each having on each side edge of said frame, receiving screw holes for attaching said L-shaped connectors to said platforms;

said L-shaped connector further comprising two flat pieces integrally and perpendicularly connecting along one edge at a 90 degree angle;

each set of two of said L-shaped connectors attaching to said upper and lower ends of each of said vertical side posts next to said frames of said upper and lower platforms, respectively, such that one side integrally attaches to the side of said vertical side post, and the edge of said other piece extends out perpendicularly along the edge of the side of said platform frame; and the face of said other piece fixedly attaching to the outside of said side panels of said platform such there is the L-connector attaches to said platform on either said of said frame of said platform.

11. An elevating work platform structure as recited in claim 10, said guiding means further comprising two sets of two guiding rollers integrally attached to the outside of each of said side posts at the upper and lower end for guiding said elevating work platform along elevator cables.

12. An elevating work platform structure as recited in claim 11, further comprising a locking mechanism for affixing the elevating work platform within the elevator channel, said locking mechanism further comprising an air compressor for providing a volume of highly compressed air, a plurality of air tubes for connecting between the air compressor and each air compressing cylinders, a press lock bar received within each of the air compressing cylinders, and a supporter provided at the end of a press lock bar, such that the highly compressed air generated from the air compressor would be forced through the air tubes to each air compressing cylinders which would push out the press lock bar until the supporter is pressed against an inner wall of the elevator channel, so as to rigidly secure the elevating work platform within.

13. An elevating work platform structure as recited in claim 1, said platform attaching means further comprising a set of L-shaped connectors and a set of platform screws, one of said L-shaped connector and one of said platform screws per each of said upper and lower platforms;

said vertical posts having one screw hole on each side of said upper end facing in the same direction as said upper platform on the same place as said beam, and one screw hole on the lower end of said vertical posts, directly under each screw hole of said upper platform;

said upper and lower platforms each having on each side edge of said frame, receiving screw holes for attaching said L-shaped connectors to said platforms;

said L-shaped connector further comprising two flat pieces integrally and perpendicularly connecting along one edge at a 90 degree angle;

each set of two of said L-shaped connectors attaching to said upper and lower ends of each of said vertical side posts next to said frames of said upper and lower platforms, respectively, such that one side integrally attaches to the side of said vertical side post, and the edge of said other piece extends out perpendicularly along the edge of the side of said platform frame; and the face of said other piece fixedly attaching to the outside of said side panels of said platform such there is the L-connector attaches to said platform on either said of said frame of said platform.

14. An elevating work platform structure as recited in claim 13, said guiding means further comprising two sets of two guiding rollers integrally attached to the outside of each of said side posts at the upper and lower end for guiding said elevating work platform along elevator cables.

15. An elevating work platform structure as recited in claim 14, further comprising a locking mechanism for affixing the elevating work platform within the elevator channel, said locking mechanism further comprising an air compressor for providing a volume of highly compressed air, a plurality of air tubes for connecting between the air compressor and each air compressing cylinders, a press lock bar received within each of the air compressing cylinders, and a supporter provided at the end of a press lock bar, such that the highly compressed air generated from the air compressor would be forced through the air tubes to each air compressing cylinders which would push out the press lock bar until the supporter is pressed against an inner wall of the elevator channel, so as to rigidly secure the elevating work platform within.

16. An elevating work platform structure as recited in claim 1, said guiding means further comprising two sets of two guiding rollers integrally attached to the outside of each of said side posts at the upper and lower end for guiding said elevating work platform along elevator cables.

17. An elevating work platform structure as recited in claim 16, further comprising a locking mechanism for affixing the elevating work platform within the elevator channel, said locking mechanism further comprising an air compressor for providing a volume of highly compressed air, a plurality of air tubes for connecting between the air compressor and each air compressing cylinders, a press lock bar received within each of the air compressing cylinders, and a supporter provided at the end of a press lock bar, such that the highly compressed air generated from the air compressor would be forced through the air tubes to each air compressing cylinders which would push out the press lock bar until the supporter is pressed against an inner wall of the elevator channel, so as to rigidly secure the elevating work platform within.

18. An elevating work platform structure as recited in claim 1, further comprising a locking mechanism for affixing the elevating work platform within the elevator channel, said locking mechanism further comprising an air compressor for providing a volume of highly compressed air, a plurality of air tubes for connecting between the air compressor and each air compressing cylinders, a press lock bar received within each of the air compressing cylinders, and a supporter provided at the end of a press lock bar, such that the highly compressed air generated from the air compressor would be forced through the air tubes to each air compressing cylinders which would push out the press lock bar until the supporter is pressed against an inner wall of the elevator channel, so as to rigidly secure the elevating work platform within.

19. An elevating work platform structure as recited in claim 1, said horizontal beam further comprising a plurality of tension rings disposed on the lower surface of said horizontal beam;

each of said side posts further comprises a hook ring disposed at a center of said inner surface of said side posts; and two tension adjusting cables, each with two hooking ends, one end of each of said tension cable hooking on one of said tension rings of the horizontal beam and the other end of each of said tension cable hooking on the hook ring of each side post, respectively, for adjusting the tension on the elevating work platform.

20. An elevating work platform structure as recited in claim 1, said side posts further comprising a set of reinforced bars for enhancing the load ability of the lower platform; and said reinforced bars attaching to the middle of one of the surfaces of said side posts and extending outward on either side of said side posts attaching to either side of said frame of said lower platforms.

* * * * *